US011692541B2

(12) United States Patent
Shand et al.

(10) Patent No.: US 11,692,541 B2
(45) Date of Patent: Jul. 4, 2023

(54) ELECTRIC MOTOR PUMP SYSTEM AND METHOD

(71) Applicant: Eaton Intelligent Power Limited, Dublin (IE)

(72) Inventors: Charles Shand, Southampton (GB); Mark D. Stacey, Portsmouth (GB); Simon Orde, Bognor Regis (GB); Steven C. Birch, Portsmouth (GB); Stephen Devan, Madison, MS (US); Phillip Galloway, Madison, MS (US); Douglas Scott, Brandon, MS (US); Daniel Chapman, Flowood, MS (US)

(73) Assignee: Eaton Intelligent Power Limited, Dublin (IE)

( * ) Notice: Subject to any disclaimer, the term of this patent is extended or adjusted under 35 U.S.C. 154(b) by 0 days.

(21) Appl. No.: 17/255,115

(22) PCT Filed: Jun. 28, 2019

(86) PCT No.: PCT/EP2019/067353
§ 371 (c)(1),
(2) Date: Dec. 22, 2020

(87) PCT Pub. No.: WO2020/002612
PCT Pub. Date: Jan. 2, 2020

(65) Prior Publication Data

US 2021/0270258 A1 Sep. 2, 2021

Related U.S. Application Data

(60) Provisional application No. 62/691,925, filed on Jun. 29, 2018.

(51) Int. Cl.
*F04B 49/00* (2006.01)
*F04B 49/06* (2006.01)
(Continued)

(52) U.S. Cl.
CPC ..... *F04B 49/002* (2013.01); *F04B 27/18* (2013.01); *F04B 49/06* (2013.01); *F04B 49/103* (2013.01); *F04B 49/08* (2013.01)

(58) Field of Classification Search
CPC ..... F04B 49/002; F04B 49/06; F04B 49/103; F04B 49/08; F04B 27/18
(Continued)

(56) References Cited

U.S. PATENT DOCUMENTS 3,406,850 A * 10/1968 Hancox ..... E02F 9/2267 60/452
4,205,590 A 6/1980 Stegner
(Continued)

FOREIGN PATENT DOCUMENTS

DE 102012012141 A1 12/2013
EP 0087773 A1 9/1983
(Continued)

OTHER PUBLICATIONS

International Search Report, PCT/EP2019/067353, dated Sep. 19, 2019.
(Continued)

*Primary Examiner* — Philip E Stimpert
(74) *Attorney, Agent, or Firm* — Merchant & Gould, P.C.

(57) ABSTRACT

An electric motor pump system includes a variable displacement pump, an electric motor connected to drive the variable displacement pump, a first control piston configured to limit an output pressure characteristic of the pump, and a second control piston controlled via a servo valve according to an output speed of the electric motor. In embodiments, the second piston is configured to maintain a substantially constant output flow of the pump as the output speed of the electric motor changes. With embodiments, the first and
(Continued)

second control pistons may be configured to act on a yoke of the variable displacement pump.

17 Claims, 2 Drawing Sheets

(51) Int. Cl.
*F04B 49/10* (2006.01)
*F04B 27/18* (2006.01)
*F04B 49/08* (2006.01)

(58) Field of Classification Search
USPC ..... 417/270
See application file for complete search history.

(56) References Cited

U.S. PATENT DOCUMENTS

| | | | | |
|---|---|---|---|---|
| 5,486,097 | A * | 1/1996 | Schaffner | F04B 49/002 417/218 |
| 6,234,758 | B1 * | 5/2001 | Pawelski | F04B 11/0016 417/26 |
| 6,374,722 | B1 * | 4/2002 | Du | F04B 1/324 417/222.1 |
| 2006/0198736 | A1 | 9/2006 | Rousseau | |
| 2014/0060034 | A1 | 3/2014 | Du | |
| 2016/0332509 | A1 * | 11/2016 | Seeger | F04B 49/20 |

FOREIGN PATENT DOCUMENTS

| | | | |
|---|---|---|---|
| EP | 0367476 | A1 | 5/1990 |
| EP | 0 576 727 | A1 | 1/1994 |
| EP | 2341230 | A2 | 7/2011 |
| JP | 1-116294 | A | 5/1989 |
| KR | 10-2012-0060441 | A | 6/2012 |
| KR | 10-1510397 | B1 | 4/2015 |

OTHER PUBLICATIONS

Vickers Fluid Systems Brochure, 64 pages (Jun. 2000).
Exhibit A showing prior art Vickers® brand products, Jul. 2016 (date added by PES Feb. 23, 2013).
European Office Action for Application No. 19739924.9 dated Jan. 4, 2023.

* cited by examiner

ELECTRIC MOTOR PUMP SYSTEM AND METHOD

CROSS-REFERENCE TO RELATED APPLICATIONS

This application is a National Stage Patent Application of International Patent Application No. PCT/EP2019/067353, filed Jun. 28, 2019, which claims the benefit of U.S. Application Ser. No. 62/691,925, filed Jun. 29, 2018, the contents of each are incorporated by reference in their entireties.

TECHNICAL FIELD

This invention generally relates to pumps, including electric motor pumps (EMP) and systems, and methods of controlling electric motor pumps.

BACKGROUND

Some designs of electric motor pump systems include electronics, such as dedicated, extra, and/or high-power electronics, for controlling the pumps. Additional electronics may add weight and/or complexity, and may be difficult to service, particularly in situations where the pump system is installed in a relatively inaccessible location.

Accordingly, there is a desire to provide solutions or options that improve electric motor pumps and systems, for example by simplifying the systems and/or reducing their weight. Weight reduction is particularly important in aerospace applications and the like.

SUMMARY

According to a first aspect of the disclosure, there is provided an electric motor pump system comprising: a variable displacement pump; an electric motor connected to drive the variable displacement pump; a first control piston configured to limit an output pressure characteristic of the pump; and a second control piston controlled via a servo valve according to an output speed of the electric motor, the second piston being configured to maintain a substantially constant output flow of the pump as the output speed of the electric motor changes.

As the system is configured to limit the output pressure of the valve using a pressure-controlled piston, and to maintain a substantially constant output flow as the speed of the electric motor (which drives the variable displacement pump) changes by means of a servo valve, the system has less need for complex electronics, and so can be simplified and made lighter.

Means can be provided for sensing the pressure at the outlet of the pump. Any suitable means, such as a direct pressure sensor, can be used.

The first control piston can be controlled in any suitable manner, as long as it can respond to the outlet pressure of the pump. In a preferred form, the first control piston is controlled via a compensator spool.

The servo valve can operated in any suitable manner. However, it is preferred for the servo valve to be supplied with pressurized fluid from the outlet of the pump.

Preferably, the first control piston and the second control piston act on a yoke of the variable displacement pump to vary the displacement of the variable displacement pump. However, the system of the disclosure can be used on any type of variable displacement pump, as long as speed compensation and pressure compensation can be carried out.

BRIEF DESCRIPTION OF THE DRAWINGS

An embodiment of the disclosure will now be described by way of example only and with reference to the accompanying drawings, in which.

DETAILED DESCRIPTION

Figure 1:
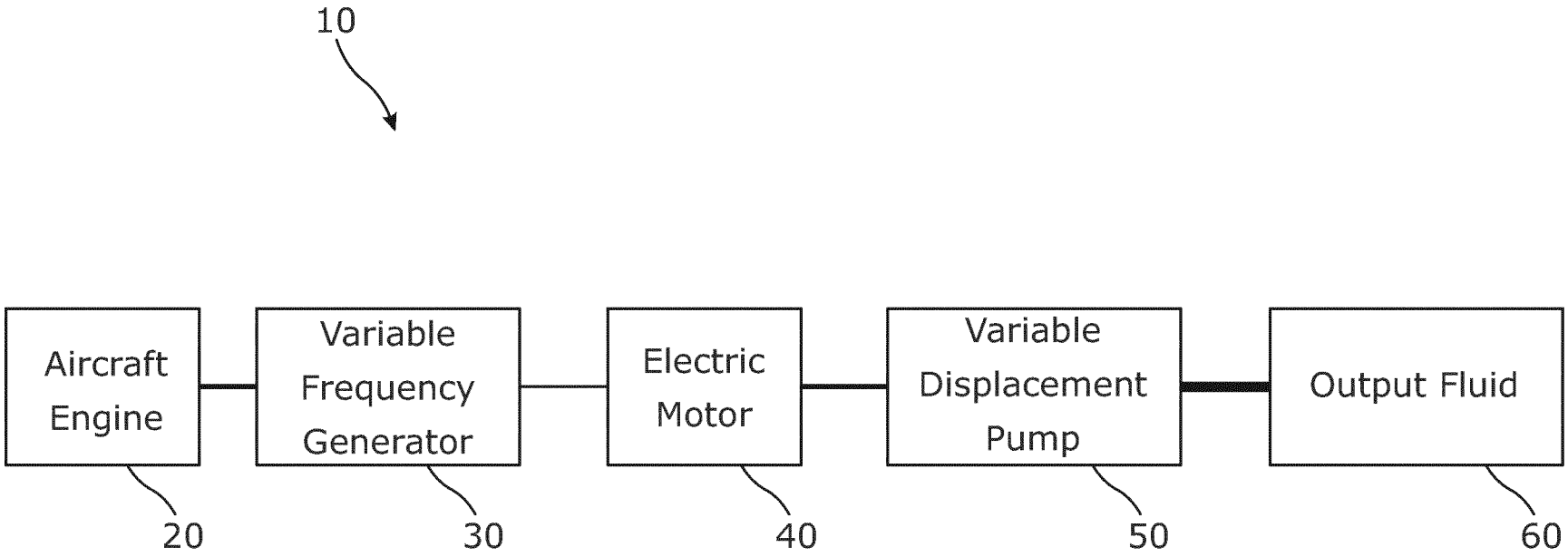
FIG. 1 is a schematic view generally illustrating a electric motor pump system according to an aspect of the present disclosure.

FIG. 1 shows a schematic illustration of an electric motor pump system 10 for use in an aircraft. The system includes an aircraft engine 20, a variable frequency generator 30, an electric motor 40, and a variable displacement pump 50. The pump discharges an output fluid 60.

The aircraft engine 20 drives the variable frequency generator 30, which produces a constant voltage output with a variable frequency (which may be between about 380 Hz and about 800 Hz). The variable frequency generator 30 powers the electric motor 40, and may also control it. The electric motor 40 may be an induction motor, and the output speed of the motor may depend on the frequency of the output of the variable frequency generator. The motor 40 may be, for example, a line start permanent magnet electric motor.

The pump 50 is driven by the output shaft of the electric motor 40. As mentioned above, the pump 50 is a variable displacement pump, where the displacement (the amount of fluid delivered for each stroke) can be varied, for example by changing the angle of a yoke 130 (see FIG. 2). The pump 50 may be speed compensated and pressure compensated.

Figure 2:
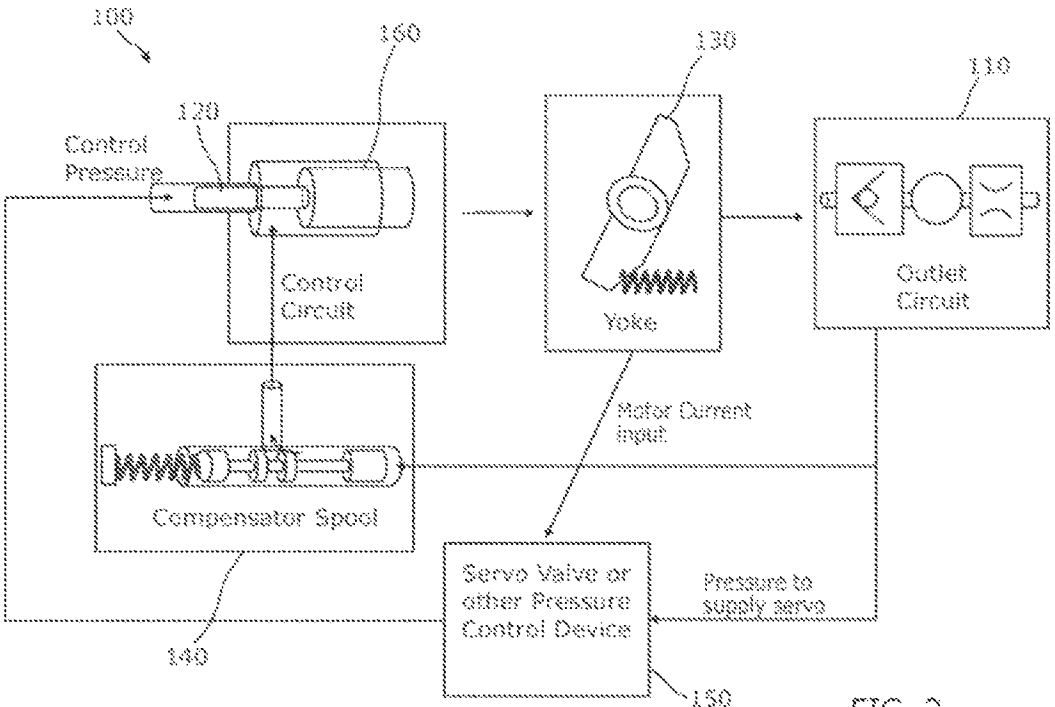
FIG. 2 is a schematic view generally illustrating an embodiment of a pump suitable for use in the pump system of FIG. 1.

The pump, and in particular the arrangements for speed compensation and pressure compensation, will be described in more detail with reference to FIG. 2. In this Figure, the pump is generally denoted by the reference numeral 100.

With pressure compensation, the pump 100 is configured to modify the output flow based on the fluid pressure at the outlet of the pump (generally indicated as an "outlet circuit" and denoted by the reference numeral 110). For example, if the fluid pressure at the outlet 110 of the pump is high (and in particular, is above a threshold value), then the displacement of the pump can be reduced to reduce the output flow. The displacement can be controlled by means of a first control piston 160 that acts on a yoke 130 of the variable displacement pump 100. Movement of the first control piston 160 can be controlled by a compensator valve/spool 140, as shown in FIG. 2, which is in communication with the outlet 110 of the pump.

With speed compensation, the pump 100 is configured to provide a substantially constant output flow across a range of speeds of the electric motor 40. To provide speed compensation, a servo valve 150 is controlled according to the speed of the output shaft of the electric motor 40. The speed of the electric motor 40 may be determined based on the electric current supplied to the electric motor 40 from the variable frequency generator 30, or may be measured directly using a resolver or a similar sensor connected to the motor output shaft (not shown). As the speed of the motor output shaft increases, the servo valve 150 controls a second control piston 120 to reduce the displacement of the pump 100 by changing the angle of the yoke 130, and thus maintain a substantially constant output flow. Likewise, if the speed decreases, the yoke 130 can be adjusted to increase the displacement to maintain a substantially constant output flow. The servo valve can be supplied with pressurized fluid from the outlet 110 of the pump 100.

The first and second control pistons 160, 120 can be disposed coaxially, and preferably concentrically. In a preferred arrangement, the first control piston is larger than the second control piston.

Thus, systems according to at least preferred embodiments of the present disclosure may be configured to provide pressure and speed compensated flow, such as across some or all frequencies of operation.

Power may be limited dynamically for running at any applied electrical frequency (that is, any frequency generated by the variable frequency generator 30), such as without control electronics, which may improve reliability and/or reduce system weight.

In some embodiments, the system may include a thermal sensor. At higher temperatures, power may be reduced.

Thus, the system does not necessarily need to include high power electronics to control the flow across various speeds of the motor (for example, it may not need to include a rectifier circuit and controller), and this can reduce the complexity and weight of the system, and/or improve the reliability of the system. Clearly, a reduction in weight and complexity and an improvement in reliability are highly desirable when the system is used in an aerospace application.

The invention claimed is:

1. An electric motor pump system, comprising:
a variable displacement pump;
an electric motor connected to drive the variable displacement pump;
a first control piston configured to limit an output pressure characteristic of the pump; and
a second control piston controlled via a servo valve according to an output speed of the electric motor, the second control piston being configured to maintain a constant output flow of the variable displacement pump as the output speed of the electric motor changes;
wherein the first control piston and the second control piston have different diameters; and
wherein the first control piston and the second control piston act on a yoke of the variable displacement pump to vary the displacement of the variable displacement pump.

2. The electric motor pump system as claimed in claim 1, including a means for sensing the pressure at an outlet of the variable displacement pump.

3. The electric motor pump system as claimed in claim 1, wherein the first control piston is controlled via a compensator spool.

4. The electric motor system as claimed in claim 1, wherein the servo valve is supplied with pressurized fluid from the outlet of the variable displacement pump.

5. The electric motor system as claimed in claim 1, including a direct pressure sensor that senses pressure at the outlet of the variable displacement pump.

6. The electric motor pump system as claimed in claim 2, wherein the first control piston is controlled via a compensator spool.

7. The electric motor pump system as claimed in claim 1, wherein the variable displacement pump is driven by an output shaft of the electric motor.

8. The electric motor pump system as claimed in claim 1, wherein the displacement of the variable displacement pump is varied by changing an angle of the yoke.

9. The electric motor pump system as claimed in claim 1, wherein the first control piston and the second control piston are disposed coaxially.

10. The electric motor pump system as claimed in claim 9, wherein the first control piston and the second control piston are disposed concentrically.

11. The electric motor pump system as claimed in claim 10, wherein the first control piston has a larger diameter than the second control piston.

12. The electric motor pump system as claimed in claim 1, wherein the first control piston and the second control piston are disposed concentrically.

13. The electric motor pump system as claimed in claim 12, wherein the first control piston has a larger diameter than the second control piston.

14. The electric motor pump system as claimed in claim 1, wherein the first control piston has a larger diameter than the second control piston.

15. An electric motor pump system, comprising:
a variable displacement pump;
an electric motor connected to drive the variable displacement pump;
a first control piston configured to limit an output pressure characteristic of the pump; and
a second control piston controlled via a servo valve according to an output speed of the electric motor determined based on electric current provided to the electric motor from a variable frequency generator, the second control piston being configured to maintain a constant output flow of the variable displacement pump as the output speed of the electric motor changes;
wherein the first control piston and the second control piston have different diameters; and
wherein the first control piston and the second control piston act on a yoke of the variable displacement pump to vary the displacement of the variable displacement pump.

16. The electric motor pump system of claim 15, wherein the first control piston and the second control piston are disposed coaxially.

17. An electric motor pump system, comprising:
a variable displacement pump;
an electric motor connected to drive the variable displacement pump;
a variable frequency generator configured to provide power to the electric motor, the variable frequency generator producing a constant voltage output with a variable frequency, wherein an output speed of the electric motor depends upon a frequency of the constant voltage output of the variable frequency generator;
a first control piston configured to limit an output pressure characteristic of the variable displacement pump; and
a second control piston controlled via a servo valve according to an output speed of the electric motor determined based on a frequency of the electric current provided to the electric motor from the variable frequency generator, the second control piston being configured to maintain a constant output flow of the variable displacement pump as the output speed of the electric motor changes;

wherein the first control piston and the second control piston have different diameters.

* * * * *